US005590624A

United States Patent [19]

Emond et al.

[11] Patent Number: 5,590,624

[45] Date of Patent: Jan. 7, 1997

[54] ENGINE COOLING SYSTEMS

[75] Inventors: Jean P. Emond, Plancenoit, Belgium; Robert G. Saville, Lacon, Ill.

[73] Assignee: Caterpillar Inc., Peoria, Ill.

[21] Appl. No.: 414,261

[22] Filed: Mar. 31, 1995

[51] Int. Cl.[6] ..... F01P 7/10

[52] U.S. Cl. ..... 123/41.49; 123/178 E; 180/68.1

[58] Field of Search ..... 123/41.49, 198 E; 415/102, 211.2; 180/68.1

[56] References Cited

U.S. PATENT DOCUMENTS

| | | | |
|---|---|---|---|
| 4,382,481 | 5/1983 | Moore | 180/68.1 |
| 4,634,342 | 1/1987 | Rodewald | 415/211.2 |
| 5,240,373 | 8/1993 | Mita et al. | 123/41.49 |

FOREIGN PATENT DOCUMENTS

| | | | |
|---|---|---|---|
| 107146 | 7/1898 | Germany | 415/102 |

*Primary Examiner*—Noah P. Kamen
*Attorney, Agent, or Firm*—Dennis C. Skarvan; Alan J. Hickman

[57] ABSTRACT

An engine cooling system arrangement for use with construction machinery to reduce noise includes an engine enclosure separated from a cooling system enclosure by a noise barrier. An axial flow fan is disposed in suction mode between a heat exchanger and the noise barrier in the cooling system enclosure. The cooling system enclosure receives ambient air through a first inlet and engine compartment air through a second inlet. The fan induces the flow of cooling air from the first inlet, through the heat exchanger and across the fan to between the fan and noise barrier. A diffuser attached to the fan induces the flow of engine compartment air from the second inlet to between the fan and noise barrier, the cooling air and the engine compartment air being exhausted from between the fan and the noise barrier radially outward through the tops and sides of the cooling system enclosure.

7 Claims, 4 Drawing Sheets

ENGINE COOLING SYSTEMS

TECHNICAL FIELD

The present invention relates generally to an engine cooling system arrangement for use with construction machinery to reduce noise and, more particularly, to a cooling fan arrangement in a cooling system compartment that induces the flow of air from multiple inlets into the cooling system compartment.

BACKGROUND ART

Legislation mandating the reduction of noise has forced manufacturers of construction machinery to reduce or shield the level of noise produced by both the Cooling system and engine of the construction machinery. Engine noise can be attenuated by providing a cooling system enclosure separate from the engine enclosure. See, for example, U.S. Pat. No. 3,866,580 entitled "Air-Cooled Enclosure for an Engine" issued to Whitehurst et al. Feb. 18, 1975. Because the engine enclosure is separated from the cooling system in Whitehurst et al., an ejector is provided for drawing ambient cooling air through an inlet into the engine compartment and out through an outlet of the engine compartment. The ejector utilizes the flow of exhaust gasses from the exhaust pipe to create a low pressure within the outlet in order to draw the cooling air therethrough.

What is needed is an improved engine cooling system. Such an engine cooling system preferably includes a cooling system enclosure separated from the engine enclosure by a noise barrier. Such an engine cooling system preferably includes a cooling fan capable of inducing cooling flow through the cooling system enclosure and the engine enclosure. Also, such an engine cooling system should be easily adapted to conventional engine cooling systems.

DISCLOSURE OF THE INVENTION

According to one embodiment of the present invention, an engine cooling system arrangement for use with construction machinery to reduce noise is disclosed, comprising an engine compartment adapted for enclosing an engine therein, a cooling system compartment disposed adjacent to the engine compartment, a noise barrier disposed between the engine compartment and the cooling system compartment, the cooling system compartment including a first inlet in communication with a source of cooling air, a second inlet in communication with engine compartment air from the engine compartment and an outlet for exhausting the cooling air and the engine compartment air from the cooling system compartment, a heat exchanger disposed in the cooling system compartment, and a fan disposed between the heat exchanger and the noise barrier, the fan inducing the flow of cooling air from the first inlet, through the heat exchanger and across the fan to between the fan and the noise barrier and inducing the flow of engine compartment air from the second inlet to between the fan and the noise barrier, the cooling air and the engine compartment air being exhausted from between the fan and the noise barrier radially outward through the outlet.

According to another embodiment of the present invention, a cooling fan arrangement for use with an engine cooling systems of a construction machine to induce air flow through the cooling system is disclosed, comprising an axial flow fan including a number of axial flow blades for receiving air from a first source and directing the air from the first source in an axial direction, a diffuser disposed adjacent to and downstream of the axial flow fan for directing a portion of the air from the first source outward of the axial flow fan to induce the flow of air from a second source, and a fan drive connected to the axial flow fan and the diffuser for rotating the axial flow fan and diffuser together.

According to yet another embodiment of the present invention, a diffuser for use with an axial flow cooling fan in a cooling system compartment of a construction machine is disclosed, the fan inducing the flow of air from a first source and the diffuser inducing the flow of air from a second source, the diffuser comprising a central portion adapted for mounting to a cooling fan and a peripheral portion adapted for receipt adjacent to blades of the cooling fan, the peripheral portion extending radially outward and downstream of the central planar portion for directing air flowing through the cooling fan radially outward thereof to induce the flow of air from a second source.

BEST MODE FOR CARRYING OUT THE INVENTION

Figure 1:
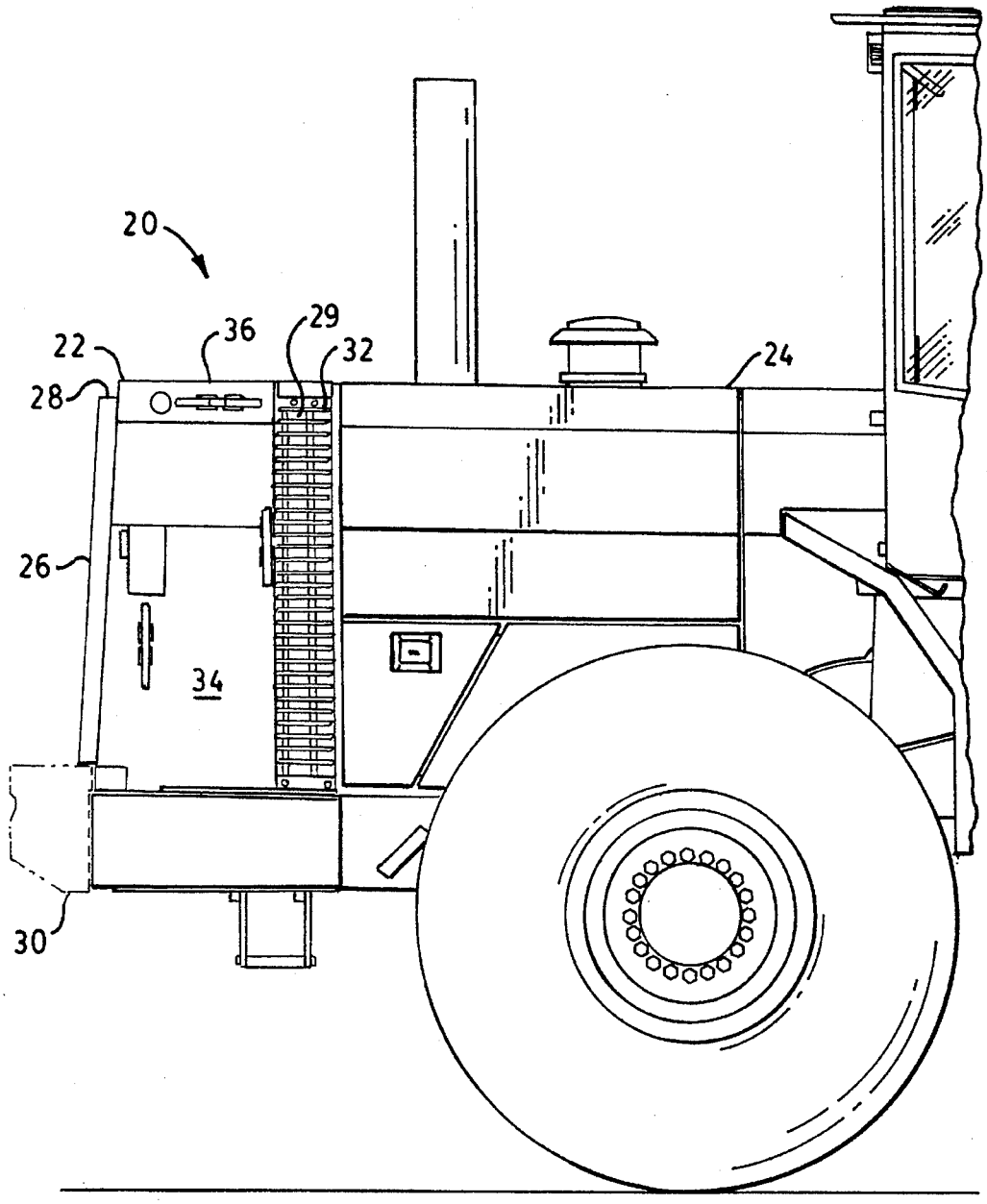
FIG. 1 is a side elevational view of the driving portion of a construction machine according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, the rear portion of a construction machine 20 is shown. Machine 20 includes a cooling system enclosure 22 disposed adjacent to an engine enclosure 24. By separating the cooling enclosure from the engine enclosure, the cooling enclosure is open to ambient air while the engine enclosure is substantially closed to attenuate engine noise. Cooling system enclosure 22 includes a first inlet 26 in communication with a source of cooling air. In the preferred embodiment, the source of cooling air is ambient air, and enclosure 22 receives the ambient air through conventional louvers 28 movably disposed in the aft end 30 of machine 20. Cooling system enclosure 22 includes an outlet 29 for exhausting air from enclosure 22. In the preferred embodiment, enclosure 22 exhausts air through conventional louvers 32 fixedly disposed across a portion of the sides 34 and top 36 of enclosure 22.

Engine enclosure 24 is separated from cooling system enclosure 22 and, as such, has a separate inlet (not shown) in communication with a source of cooling air. In the preferred embodiment, the source of cooling air is ambient air received into enclosure 24 through spacing between enclosure 24 and the machine transmission housing.

Figure 2:
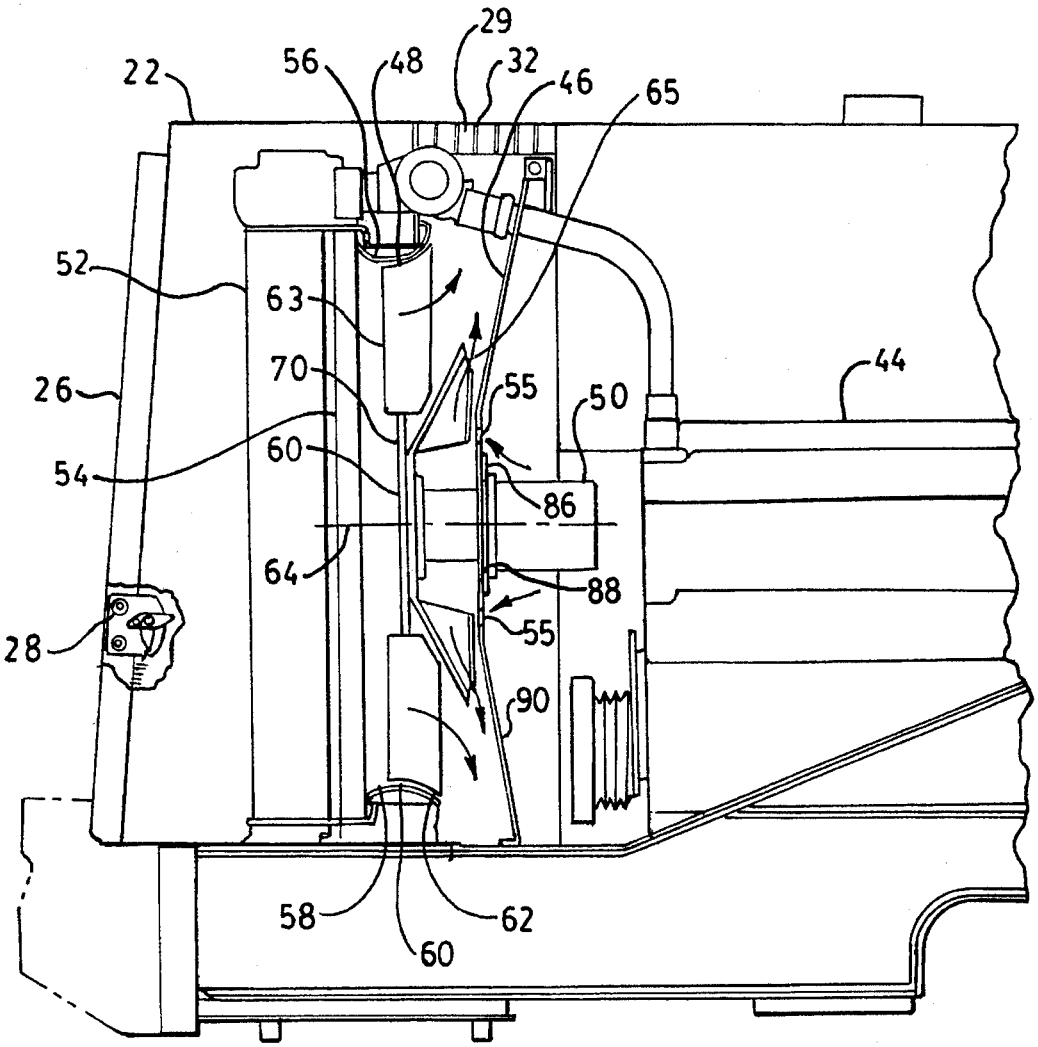
FIG. 2 is a cross-sectional view of the embodiment of FIG. 1.

Referring now to FIG. 2, cooling system enclosure 22 and engine enclosure 24 are shown in greater detail. Engine enclosure 24 is sized for receiving a diesel engine 44 and its associated accessories therein. Enclosure 24 is separated from enclosure 22 by a noise barrier 46.

Cooling system enclosure 22 includes a cooling fan 48 rotatably mounted independent of engine 44 downstream of a radiator 52 and oil cooler 54, or other such heat exchanger. The placement of fan 48 between one or more heat exchangers and a noise barrier serves to further attenuate cooling fan noise. Fan 48 is hydraulically driven by a motor 50 at a speed proportional to engine load, thereby maintaining a uniform engine enclosure temperature. Motor 50 is mounted to noise barrier 46 and derives hydraulic power from engine 44 to drive fan 48. Fan 48 induces ambient air flow through inlet louvers 28, through heat exchangers 52 and 54 and across fan 48. Flow exits fan 48 between fan 48 and noise barrier 46 and is discharged through louvers 32 of outlet 29.

A number of through holes 55 are provided in noise barrier 46 and define a second inlet for enclosure 22. As discussed hereinafter in greater detail, holes 55 communicate air from engine enclosure 24 to enclosure 22 to be ejected along with the cooling air induced by fan 48 from the first inlet 26, as indicated by the arrows. As a result, air is circulated through engine enclosure 24 without the added cost of an ejector such as that shown in U.S. Pat. No. 3,866,580, or additional fan and fan drives in the engine enclosure.

In the preferred embodiment, a fan shroud 56 is disposed about fan 48 to reduce noise produced by fan 48. Fan shroud 56 includes a radially converging inlet portion 58, a cylindrical transition portion 60 and a radially diverging outlet portion 62. Inlet portion 58 and outlet portion 62 each are shaped axisymmetric about the central axis 64 of fan 48. The radially converging axisymmetric shape of inlet portion 58 uniformly accelerates flow into the fan to reduce inlet distortion and minimize turbulence intensity. The cylindrical transition portion 60 permits the fan to be mounted at low running clearances with the fan shroud, thereby reducing recirculation and turbulence across the leading edge of the fan blades. The radially diverging axisymmetric shape of outlet portion 62 uniformly decelerates or diffuses flow exiting the fan to maintain minimal recirculation and turbulence across the fan blades.

Fan 48 is an axial flow fan that imparts primarily an axial velocity component to the flow of cooling air. A diffuser 65 is rotatably mounted downstream of fan 48 and imparts a radial velocity component to the flow of cooling air exiting fan 48. Alternately, fan 48 is contemplated as being a mixed flow fan in lieu of the aforementioned axial flow fan and radial flow diffuser. In such a mixed flow configuration, the blades of fan 48 are configured to impart both axial and radial velocity components to the flow of cooling air.

In either case, by imparting a radial velocity component to the flow of air exiting fan 48, a low pressure region is created adjacent to the discharge of fan 48 to induce the flow of engine compartment air through holes 55 from engine enclosure 24. Noise barrier 46 is further disposed downstream of diffuser 65 and is configured to assist in directing the flow of air exiting fan 48 radially outward through outlet 29. Diffuser 65 and noise barrier 46 are configured to efficiently change the direction of cooling air flow from axial to radial and exhaust the cooling air flow with a minimum of turbulence and noise produced by air flow through the cooling system.

Figure 3:
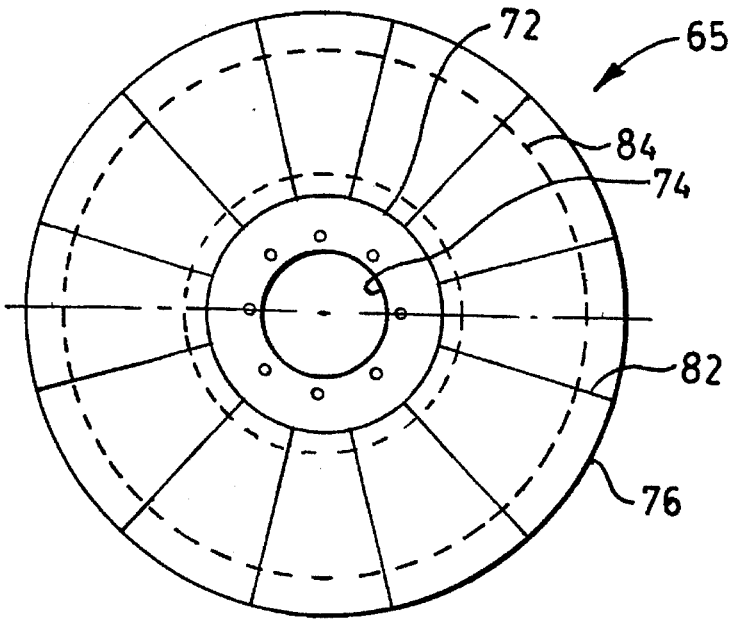
FIG. 3 is a front elevational view of a diffuser of the embodiment of FIG. 1.
Figure 4:
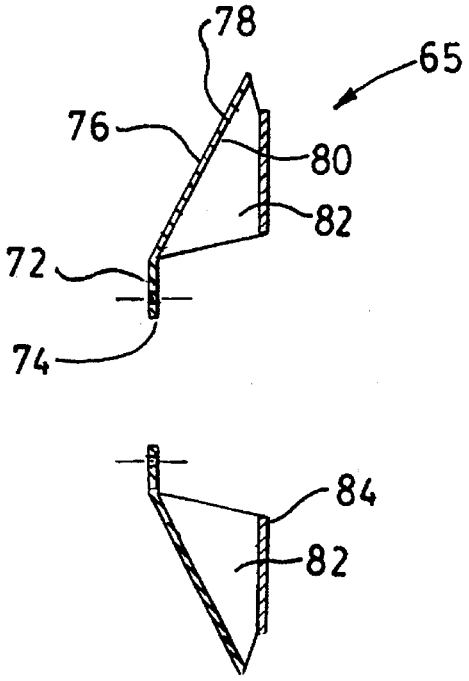
FIG. 4 is a side elevational view of the diffuser of FIG. 3.

In the specific preferred embodiment shown, fan 48 includes a cylindrical hub portion 66 mounted to fan drive 50. A number of axial flow fan blades 68 are attached to hub portion 66 via a circular planar portion 70. Referring also to FIGS. 3 and 4, diffuser 65 includes a circular mounting flange 72 adapted for mounting over hub portion 66. In particular, flange 72 defines a circular bore 74 sized for receiving hub portion 66 therethrough. As such, diffuser 65 mounts on fan 48 to define a fan assembly that imparts both axial and radial velocity components similar to a mixed flow fan, but at a substantially reduced cost. Further, such a diffuser is easily added to an existing axial flow fan in a conventional cooling system to achieve radial flow exiting an axial flow fan.

To impart a radial velocity component to the flow of air exiting fan 48, diffuser 65 includes a peripheral portion 76 adapted for receipt adjacent to the hub of fan blades 68. As such, diffuser 65 has a diameter smaller than the diameter of the fan to reduce tip speed and associated noise produced by the diffuser. Peripheral portion 76 extends radially outward and axially aft of flange 72 and defines an outer surface 78 configured to direct a portion of the flow of air induced by fan blades 48 radially outward of the cooling fan. For ease of manufacture, peripheral portion 76 is conic in shape and extends at a predetermined angle outward of flange 72, wherein the predetermined angle is determined by the configuration of the hub portion of fan blades 68. The conic shape further serves to shield and attenuate noise emanating from the engine enclosure through the holes 55.

Similar to diffuser 65, noise barrier 46 includes a circular mounting flange 86 adapted for mounting motor 50 thereto. In particular, flange 86 defines a circular bore 88 sized for receiving motor 50 mounted therein. To impart a radial velocity component to the flow of air exiting fan 48, noise barrier 46 includes a peripheral portion 90 that extends radially outward and axially aft of flange 86. Preferably, peripheral portion 90 is conic in shape.

Peripheral portion 76 defines an inner surface 80 adapted for mounting diffuser blades 82. Blades 82 are attached between inner surface 80 and a backing plate 84. Blades 82 actively pump air from between fan 48 and noise barrier 46 to further induce the flow of engine compartment air through holes 55 from engine enclosure 24. For ease of manufacture, blades 82 are planar members generally triangular in shape, corresponding to the predetermined angle of the conic shape of peripheral portion 76, and extend radially inward of peripheral portion 76. To maximize the added pumping by blades 82, the triangular shape of blades 82 extends across the axial space defined between fan 48 and flange 86 of noise barrier 46 to within a predetermined small running clearance with noise barrier 46 of approximately 3 to 5 mm.

Figure 5:
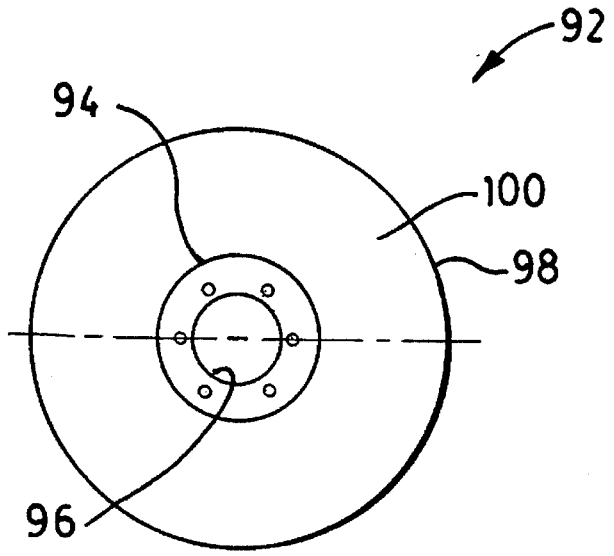
FIG. 5 is a front elevational view of an alternate diffuser for the embodiment of FIG. 1.
Figure 6:
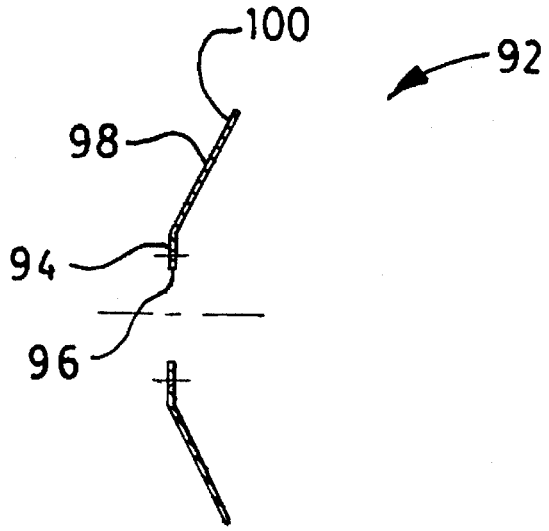
FIG. 6 is a side elevational view of the diffuser of FIG. 5.

Alternately, for applications which do not require the additional pumping provided by diffuser blades 82, a diffuser 92 is contemplated as shown in FIGS. 5 and 6. Diffuser 92 includes a circular mounting flange 94 adapted for mounting over hub portion 66. Flange 94 defines a circular bore 96 sized for receiving hub portion 66 therethrough. To impart a radial velocity component to the flow of air exiting fan 48, diffuser 92 includes a peripheral portion 98 adapted for receipt adjacent to the hub of fan blades 68. Peripheral portion 98 extends radially outward and axially aft of flange 94 and defines an outer surface 100 configured to direct a portion of the flow of air induced by fan blades 48 radially outward of the cooling fan. Similar to peripheral portion 76, peripheral portion 98 is conic in shape and extends at a predetermined angle outward of flange 94, wherein the predetermined angle is determined by the configuration of the hub portion of fan blades 68.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

For example, other embodiments than the specific preferred embodiment shown herein might come within the spirit of the invention if they separate the cooling enclosure from the engine enclosure by a substantially closed noise barrier, but still induce flow from the engine compartment through the cooling system compartment, thereby opening cooling enclosure to ambient air while maintaining the engine enclosure substantially closed to attenuate engine noise.

Still other embodiments than the specific preferred embodiment shown herein might come within the spirit of the invention if they provide an axisymmetric fan shroud about a fan disposed between one or more heat exchangers and a noise barrier to attenuate cooling fan noise.

Still yet other embodiments than the specific preferred embodiment shown herein might come within the spirit of the invention if they provide a diffuser and noise barrier configured to efficiently change the direction of cooling air flow from axial to radial and exhaust the cooling air flow with a minimum of turbulence and noise.

Still other embodiments than the specific preferred embodiment shown herein might come within the spirit of the invention if they provide a diffuser that ventilates the engine enclosure via through holes in the noise barrier and, further, configure the diffuser to shield and attenuate noise emanating from the engine enclosure through holes.

Still yet other embodiments than the specific preferred embodiment shown herein might come within the spirit of the invention if they drive the rotational speed of the fan and diffuser proportional to engine load, such as that provided by a hydraulic motor, thereby maintaining a more uniform engine enclosure temperature.

Still other embodiments than the specific preferred embodiment shown herein might come within the spirit of the invention if they provide a diffuser having a diameter smaller than the diameter of the fan to reduce tip speed and associated noise produced by the diffuser.

I claim:

1. An engine cooling system arrangement for use with construction machinery to reduce noise, comprising:

an engine compartment adapted for enclosing an engine therein;

a cooling system compartment disposed adjacent to said engine compartment;

a noise barrier disposed between said engine compartment and said cooling system compartment, said noise barrier having a second peripheral portion extending outward of a third central portion;

said cooling system compartment including a first inlet in communication with a source of cooling air, a second inlet in communication with engine compartment air from said engine compartment and an outlet for exhausting the cooling air and the engine compartment air from said cooling system compartment;

a heat exchanger disposed in said cooling system compartment;

a fan disposed between said heat exchanger and said noise barrier, said fan being an axial flow fan, said axial flow fan having a first number of blades extending outward of a first central portion and imparting an axial velocity component to the flow of cooling air; and a diffuser having a first peripheral portion extending outward of a second central portion and adjacent to said first number of blades, said second central portion being attached to said first central portion, a second number of blades extending radially inward of the first peripheral portion, each of said second number of blades extending from said first peripheral portion to within a predetermined small running clearance relative to said third central portion, said diffuser imparting a radial velocity component to the flow of cooling air;

said fan inducing the flow of cooling air from said first inlet, through said heat exchanger and across said fan to between said fan and said noise barrier and inducing the flow of engine compartment air from said second inlet to between said fan and said noise barrier, the cooling air and the engine compartment air being exhausted from between said fan and said noise barrier radially outward through said outlet.

2. The cooling system arrangement of claim 1, wherein:

said first peripheral portion is a conic portion extending at a predetermined angle outward from said second central portion; and each of said second number of blades is a planar member attached to said conic portion and extending radially inward thereof.

3. An engine cooling system arrangement for a construction machine, comprising:

an engine compartment;

a cooling system compartment positioned adjacent to and open to the engine compartment;

a noise barrier having a central portion, a peripheral portion and a plurality of holes disposed through the noise barrier central portion, said peripheral portion being conical and said noise barrier being connected in an opening between the cooling system compartment and the engine compartment, said plurality of holes being adapted to pass air therethrough;

a radiator disposed in the cooling system compartment;

a fan having a central portion, a plurality of blades extending radially outwardly from the fan central portion, and an axis of rotation, said fan being disposed in the cooling system compartment between the noise barrier and the radiator, said axis of rotation being transverse the noise barrier central portion;

a diffuser having a central portion a peripheral portion extending radially outwardly from said diffuser central portion, said diffuser being connected at the diffuser central portion to the fan and being located between the fan and the noise barrier, said diffuser portion being conical and extending outwardly from said diffuser central portion at a preselected angle toward said noise barrier, said fan drawing cooling air through the radiator and said diffuser drawing engine compartment air through the holes, said diffuser and noise barrier peripheral portions directing the drawn air radially outwardly to an exhaust outlet in the cooling system compartment.

4. The engine cooling system arrangement, as set forth in claim 3, wherein said diffuser includes a plurality of spaced diffuser blades connected to said diffuser peripheral portion, said diffuser blades extending radially outward relative to said axis and axially toward said noise barrier to within a predetermined running clearance with the diffuser central portion.

5. The engine cooling system arrangement, as set forth in claim 4, wherein the diffuser includes an annular backing plate spaced from said diffuser peripheral portion and connected to said radial flow blades.

6. The engine cooling system arrangement, as set forth in claim 4, wherein the plurality of holes are located adjacent the diffuser and within an area defined by the periphery of the diffuser.

7. The engine cooling system arrangement, as set forth in claim 3, wherein said noise barrier peripheral portion extends at a predetermined angle outward of said noise barrier central portion and in a direction away from said fan.

* * * * *